US005733063A

United States Patent [19]

Bailey et al.

[11] Patent Number: 5,733,063

[45] Date of Patent: Mar. 31, 1998

[54] APPARATUS FOR CONTROLLING VEHICULAR TRAFFIC FLOW PAST A CONTROL POINT

[75] Inventors: Clifford L. Bailey, Las Vegas, Nev.; John C. Gort, 2336 Whippletree, Las Vegas, Nev. 89119

[73] Assignee: John C. Gort, Las Vegas, Nev.

[21] Appl. No.: 708,924

[22] Filed: Sep. 6, 1996

[51] Int. Cl.[6] ..... E01F 13/08; E01F 13/12

[52] U.S. Cl. ..... 404/6; 49/49; 49/131

[58] Field of Search ..... 49/49, 132–133; 404/6, 9–11

[56] References Cited

U.S. PATENT DOCUMENTS 4,016,679 4/1977 Ellefson ..... 49/49
4,097,170 6/1978 Dickinson ..... 404/6
4,101,235 7/1978 Nelson ..... 49/49 X
5,288,164 2/1994 Nasatka ..... 404/6 X
5,588,774 12/1996 Behan ..... 404/6

*Primary Examiner*—James Lisehora
*Attorney, Agent, or Firm*—Joseph H. Roediger

[57] ABSTRACT

A vehicular traffic controller is disclosed wherein the control mechanism is positioned beneath the road surface. A plurality of transversely spaced levers extend upwardly from the surface. The levers are coupled to a shaft journaled for rotation below the road surface. Shaft rotation and lever retraction is effected by an operator to withdraw the levers to a position beneath the surface. Each lever is provided with a tire disabling member. A vehicle traversing the control point with the levers extended imparts rotation to the levers and causes the disabling members to damage the vehicle tires.

15 Claims, 5 Drawing Sheets

APPARATUS FOR CONTROLLING VEHICULAR TRAFFIC FLOW PAST A CONTROL POINT

BACKGROUND OF THE INVENTION

This invention relates to apparatus for controlling vehicular traffic flow past a control point and, in particular, to apparatus for causing vehicle tire damage in the case of an unauthorized attempt to pass the control point.

The control of traffic flow in particular areas is necessary to prevent unauthorized use of certain rights of way such as toll roads and to ensure compliance with traffic regulations. In particular, the increasing interest in private toll roads has generated substantial interest in apparatus for preventing unauthorized use of the toll road. At present, it is common to use a visual warning coupled with a vehicle sensor to alert the driver to the necessity of having to pay a toll and to generate an alarm when the vehicle operator is attempting to make unauthorized use of the roadways.

The use of lights at control points to provide a quick visual indicator to the driver of an approaching vehicle is frequently employed in situations wherein high volume traffic flow is expected. The toll collector deactivates an alarm sensor when the driver has complied with the requirements. Should the driver choose to ignore the visual indicator and travel through the control point without complying with the regulations, the alarm sounds but no damage to the vehicle results. In order to obtain a higher degree of compliance with the toll regulations, a gate arm that lowers to block the path of approaching vehicles is frequently used in connection with a light. When the vehicle is cleared to pass after payment of the toll, the gate arm raises to allow the vehicle to proceed. Gate arms have a moderate response time and the device works well in applications with medium traffic volume.

In general, gate arms are designed to break easily to prevent damage to vehicles if the vehicle operator chooses to travel past without payment of the toll. Once the gate arm is broken, no effective traffic control exists until the gate is repaired. Normally, the gate arm does not disable the vehicle. Other control mechanisms relying on sliding gates are effective in low traffic volume situations. The sliding gate, depending on its construction, has a relatively long response time as well as being relatively complex. Should the gate be broken or jammed, traffic flow is halted until the gate is repaired or replaced. The response time, the complicated mechanisms and the cost of the equipment have limited use of apparatus relying on a heavy duty barrier that extends upwardly from the road bed to block the path of a vehicle through a control point. In summary, the more effective an apparatus is to controlling vehicular traffic flow past a control point or toll booth, the more expensive to purchase and install. They are difficult to repair and are characterized by long response times limiting suitability to low volume applications.

The need for a reliable and effective traffic control apparatus leads in the direction of providing a vehicle disabling mode of operation to the apparatus. With this capability, the device is installed to control the direction of vehicular traffic by the use of tire damaging elements which leave a lasting impression, not only on the driver of the vehicle moving in the non-authorized manner, but also on passengers, on-lookers and the community at large. The observation of effective operation at the entry points of parking facilities coupled with word of mouth play major roles in the device effectiveness and the respect accorded it by a vehicle operator. The community respect accorded these directional traffic devices causes the designer of apparatus for controlling the collection of tolls to consider utilizing apparatus providing the same consequences to the vehicles of operators failing to abide by the rules and regulations of a toll road.

One traffic flow regulating device enjoying commercial success in regulating the direction of vehicular traffic flow is disclosed in U.S. Pat. No. 5,192,158 to R. E. Bailey et al. In this device, a plurality of rotationally mounted levers extend upwardly from beneath the road surface. When a vehicle tire contacts one or more of the levers, they are readily moved to a position below the road surface so as to permit authorized traffic flow. In the reverse direction, the free end of the upwardly extending lever is contacted by a vehicle tire and depressed in the direction of traffic flow thereby urging a tire disabling blade up against the tire to produce a shredding effect. The device is designed only to permit travel in one direction and impart tire damage to vehicles moving in the opposing direction and is not controlled by an operator. However, the tire disabling feature is well-suited for use in controlling the movement of vehicles past a control point.

Accordingly, the present invention is directed to the provision of a vehicular traffic controller which is capable of imparting tire damage to unauthorized vehicles traveling past the control point while permitting passage of authorized vehicles therepast without causing tire damage. In addition, the invention is adapted for use in connection with visual control systems to alert the drivers to the consequences of not complying with the requirements at the control point. Furthermore, the device is mounted beneath the road surface and capable of retraction for authorized vehicles so that no contact between authorized vehicles and the apparatus takes place during normal operation. Thus, the durability of the device and time between required maintenance cycles is increased.

SUMMARY OF THE INVENTION

This invention relates to an improved traffic controller for allowing regulation of vehicular traffic flow past a control point. The traffic controller is intended to inhibit flow of unauthorized traffic by imparting tire damage to selected vehicles. The major structural components of the apparatus are located below the road surface and include a planar member which supports motor vehicles traveling therefrom. The planar member is provided with a plurality of openings spaced laterally with each opening positioned in general alignment with the expected direction of traffic flow.

A plurality of levers extend upwardly through corresponding openings in the planar member and are oriented toward oncoming vehicles. Extended levers are positioned to contact the vehicle tire when it passes across the planar member. Rotation of the levers occurs on contact with less a traversing tire as the levers are mounted on a shaft extending transversely across the roadway beneath the planar member. The shaft is journaled for rotation and is positioned proximate to an hydraulic ram that when actuated urges the levers to a retracted position beneath the planar member. When the device is in the retracted position, a vehicle is capable of crossing the planar member without having its tires contact any portion of the apparatus other than the planar member.

When the hydraulic system of the device is not actuated, the levers extend upwardly through the plate and are intended to contact a vehicle tire moving thereacross. Tire disabling members are operatively connected to each of the levers. The disabling members are positioned beneath the planar member during periods of non-use. In the case of a vehicle tire moving against the levers, the levers are rotated in the direction of travel past the ninety degree position. A tire disabling member rotates with its corresponding lever to engage the tire. This condition exists when the vehicle is moving across the planar member without authorization from the operator. Since the objective is to ensure that each vehicle operator pays the appropriate toll or otherwise complies with the regulations of the road, the operator controls the actuation of the hydraulic system to retract the levers and also to rotate the tire engaging the members. The rotation of the shaft by the extension of a ram in the hydraulic system causes the shaft to rotate beneath the planar member so that the tire disabling members associated with each lever are not in position to contact a vehicle tire.

Since the shaft is rotated in response to an electrical signal from the operator actuating an hydraulic system, the levers are capable of retraction in a relatively rapid manner thus rendering the system suitable for medium to high volume traffic flow application. The mounting of the operative portion of the system beneath the planar surface reduces the likelihood that the system would be disabled by contact with a vehicle, but it also reduces the visibility of the device to an approaching driver. In practice, the preferred use of this invention is as a secondary control device used in conjunction with a highly visible primary traffic control device, such as a light or a gate arm. The primary system provides the visual warning to the driver to stop the vehicle at the control point. The invention enables the operator to disable an unauthorized vehicle that violates the regulations of the control point to comply with the regulations of the toll road.

The operation of the system preferably follows a sequence that allows for the spikes to be completely retracted before the primary traffic control device instructs the vehicle to enter the control point. As the vehicle approaches, the visual signal provided by the primary control device is instructing the vehicle operator. Once the operator has complied with the regulations, the vehicle is cleared to proceed and the secondary system which is the subject invention is actuated. Thus, the primary control device is normally equipped with a delay so that it does not indicate that the vehicle should proceed until the levers are retracted. When the vehicle has passed, the primary and secondary control devices return to their initial position. In the present invention, the lever arms are biased to return to their extended position after an unauthorized vehicle has passed the check point. The hydraulic system returns to the normal operating position with the ram retracted.

The present invention has been found to provide a reliable and rugged apparatus for compelling vehicle operators to abide by the rules and regulations existing at a particular control point or toll gate. The responsiveness of the device renders it well-suited for medium to heavy traffic flows. Furthermore, the system is decoupled from the hydraulic system in the normal operating position to enable the lever arms and shaft to be independently rotated beneath the planar member by the application of force. The lever arms extend at an acute angle from the planar member so that an externally applied force can cause rotation thereof in the direction opposite to that which brings the disabling members above the surface. As a result, the opportunity for the accidental protrusion of the disabling members above the planar member is essentially eliminated.

Further features and advantages of the invention will become more readily apparent from the following detailed description of a preferred embodiment when taken in conjunction with the accompanying drawings.

DESCRIPTION OF THE PREFERRED EMBODIMENT

Figure 1:
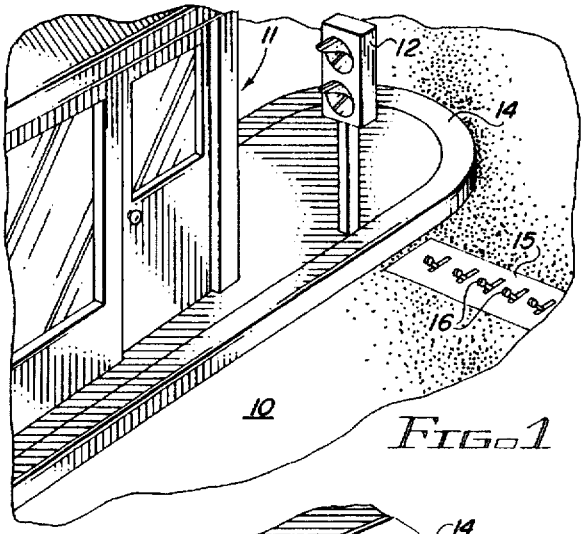
FIG. 1 is a partial view in perspective of an embodiment of the invention utilized in connection with a primary traffic control device.

Referring now to FIG. 1, a toll booth 11 is shown positioned adjacent roadway 10. The toll booth is positioned on a raised island 14 containing a traffic light 12 spaced adjacent the toll booth 11. A planar plate 15 is shown emplaced in roadway 10 with a plurality of lever arms 16 extending upwardly therefrom.

The plate 15 is shown containing a plurality of openings spaced transversely across the plate so as to cover that portion of the roadway upon which vehicular traffic is to be controlled. The objective of the invention is to permit authorized traffic flow past the toll booth and to reliably inhibit flow of unauthorized vehicles by use of a plurality of lever arms extending upwardly from the top surface of the plate. The openings are shown in the form of slots having opposing terminal portions of expanded width to accommodate a pair of discs on the end of each lever arm. When a vehicle travels past the toll booth after payment of the appropriate toll, the operator activates the system to retract the lever arms. At that time, the traffic light indicates that the vehicle is to proceed and it is then free to move across the planar plate without contacting the lever arms. Should the driver cause the vehicle to traverse the plate without the operator having activated the system to retract the lever arms, the vehicle tires contact several of the exposed ends of lever arms 16 and urge the levers into rotation in the direction of vehicular traffic.

Figure 3:
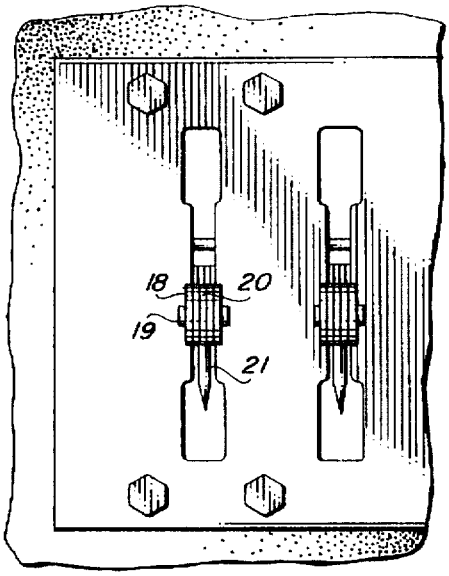
FIG. 3 is a top view of a portion of the embodiment shown in FIG. 2.
Figure 2:
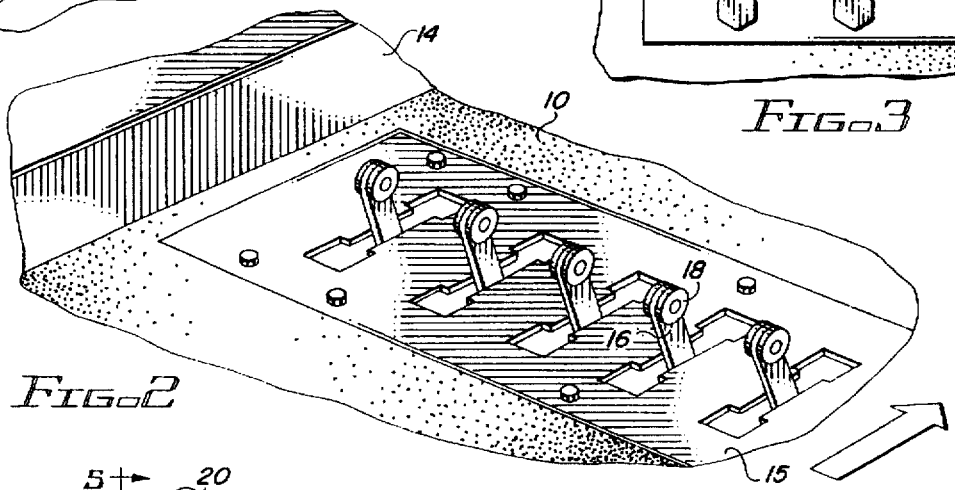
FIG. 2 is a partial view in perspective of a preferred embodiment of the invention.

In FIG. 2, the lever arms 16 are shown inclined in the direction of the oncoming vehicles. The free end of each lever arm terminates in a pair of rotatable discs 18. When a vehicle tire engages the free end of the lever arm with the discs mounted thereon, the discs are free to rotate and travel along the surface of the tire while still bearing a portion of the vehicle weight. The rotating discs decrease the frictional forces between the tire and free end of the lever arm thereby avoiding the enveloping of the end of the lever arm by the wide relative low pressure tires used by present day vehicles. As shown in FIG. 3, the central section 20 of each lever arm also contacts the surface of the vehicle tire and shares in supporting the weight thereof. The tapering of the sides and top edge portions of the lever arm serves to reduce the tendency of the tire to grab the end of the lever arm and rotate it in a direction opposite to that of the vehicle movement. A tire disabling member or spike 23 is shown beneath the plate 15 and positioned to contact a vehicle tire when the lever arm is moved in the direction of the arrow shown in FIG. 2.

Figure 4:
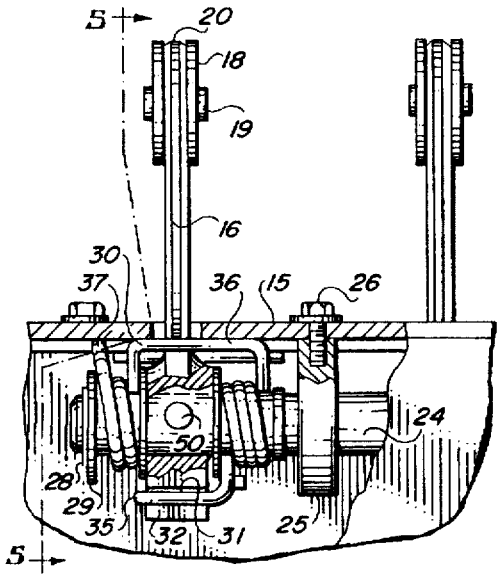
FIG. 4 is an enlarged sectional view of one lever arm and a biasing spring.
Figure 5:
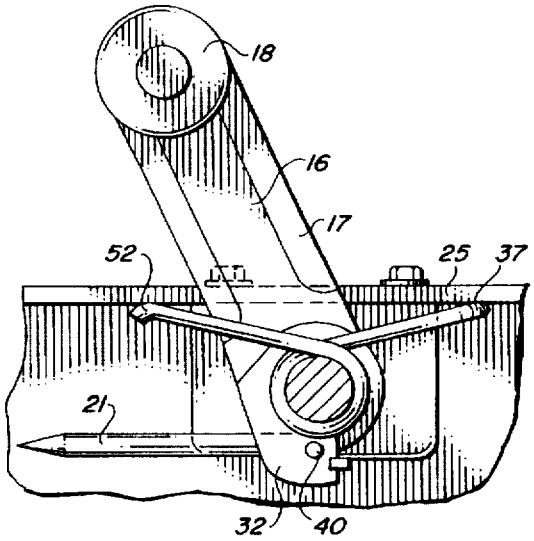
FIG. 5 a view taken as indicated by lines 5—5 of FIG. 4.

The manner of rotation of the lever arm 15 is more readily understood from FIGS. 4 and 5 wherein shaft 24 is shown extending transversely beneath plate 15. A plurality of bearing blocks 25 are spaced therebeneath to provide support for the shaft and are held in position by bolts 26 accessible from the top surface of plate 15. The second or opposing end 32 of the lever arm is provided with an opening through which shaft 24 extends. The end of the shaft is provided with a retaining clip 28 and a retention washer 29 to limit lateral movement of the lever arm on the shaft. The lever arm in FIG. 4 is shown provided with a double wound spring member 30 which urges the lever to return to an extended position after a vehicle has crossed the plate 15 and the hydraulic system begins to return to the normal operating position. The spring has a first end 35 which is received in a groove 31 and wrapped about the shaft. It also extends from a generally U-shaped central section 36 to the opposite side of the lever arm and is then wrapped about the shaft on the other side of the lever. The second end 37 of the spring extends upwardly and resides against the bottom surface of plate 15. The two spring sections wrapped about the shaft 24 on either side of central section 36 are coiled in the same direction so that the lever is continually urged to its extended position as shown in FIG. 2.

The position of the spring in its normal operating position is shown in FIG. 5 wherein the lever arm 16 extends at an approximate 45 degree angle through the opening in plate 15. The lever arms are angled to form an acute angle with the plate 15 so that an external force applied to the lever in a downward direction does not urge the piercing to emerge above the plate 15. The discs 18 mounted for rotation are positioned to contact an oncoming vehicle tire. The tapered edge portion of the lever arm shown as region 17 extends along the length of the lever until terminating just beneath the plate. The spike or tire disabling member 21 is held by retaining pin 40 in the opposing end 32. The retaining pin can be driven out and the spike removed from the socket and replaced if it is broken off during use. Alternatively, a shredding member with sharpened edge rather than a piercing member may be used.

Figure 6:
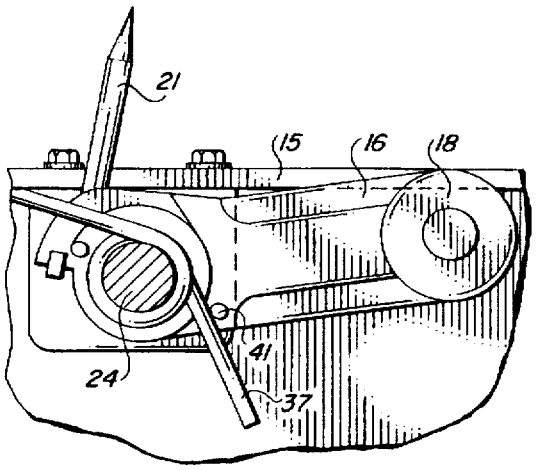
FIG. 6 is a view similar to FIG. 5 for a non-authorized vehicle traveling thereacross.

The position of tire disabling spike 21 caused by vehicle movement across the plate 15, is shown in FIG. 6. The resultant movement of the lever arm is to a position beneath the top surface of plate 15. The pressure of the tire drives the lever to this position and causes the emergence of the piercing spike 21 from beneath the plate to a position where it engages and disables the vehicle. As the lever arm 16 is urged beneath the plate, the pin 41 engages the second end 37 of the spring and is urged there against deflecting this end of the spring in the manner shown. The rotational mounting of the discs 18 on the ends of each lever arm enable the discs to rotate along the surface of the tire as it moves in the direction past the plate.

Figure 7:
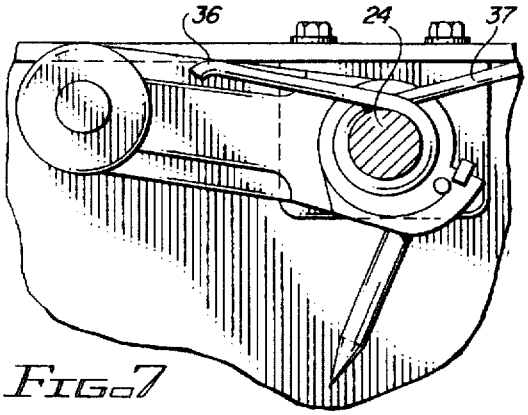
FIG. 7 is a view similar to FIG. 5 showing the movement of the lever arm and associated spike for authorized vehicle movement.
Figure 10:
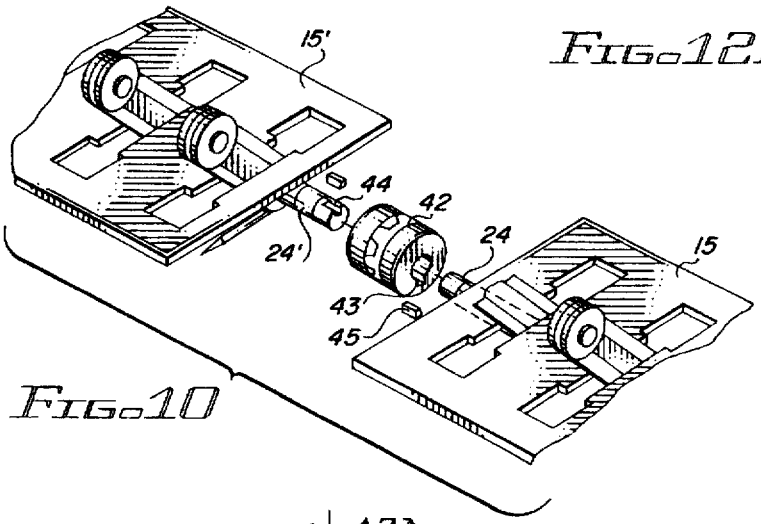
FIG. 10 is a partial view in perspective showing the coupling between shafts of adjacent embodiments.

The operation of the device for authorized vehicles travelling in the direction of the arrow in FIG. 2 is shown in FIG. 7 wherein the free end of the lever arm 16 is rotated in the counterclockwise position to a position beneath the top surface of plate 15. The rotation is caused by the activation of an hydraulic system which via an extended ram, applies a rotational force to shaft 24 to overcome the biasing force of the springs spaced along the shaft. In the embodiment shown, four springs are combined with a lever arm and equi-spaced along the shaft. Each individual lever arm need not be provided with a spring in the preferred embodiment. When a vehicle has been authorized for passage, the system operator activates the hydraulic system in advance of the primary or visual signaling system indicating that the vehicle should move forward. A delay is used in connection with the primary system to ensure that the lever arms have been rotated and the spikes will not be encountered by a passing tire of any authorized vehicle. It is to be noted that the present invention can be utilized to provide coverage for only a portion of the roadway and operate satisfactorily. However, the most effective utilization of the invention calls for joining adjacently positioned shaft assemblies beneath adjacent planar plates. In FIG. 10, the joining of adjacent shaft ends 24, 24' is shown permitting transfer of the rotational force imparted by the hydraulic ram to an adjacent shaft assembly. The rotational coupler 42 is provided with guideways 43 on either end to receive a key 45 therein. Each key 45 is also received in a similar guideway 44 located at the end of each of the shafts. By these means, the transverse coverage of the system can be extended across a wide roadway without requiring the use of a second hydraulic system.

Figure 8:
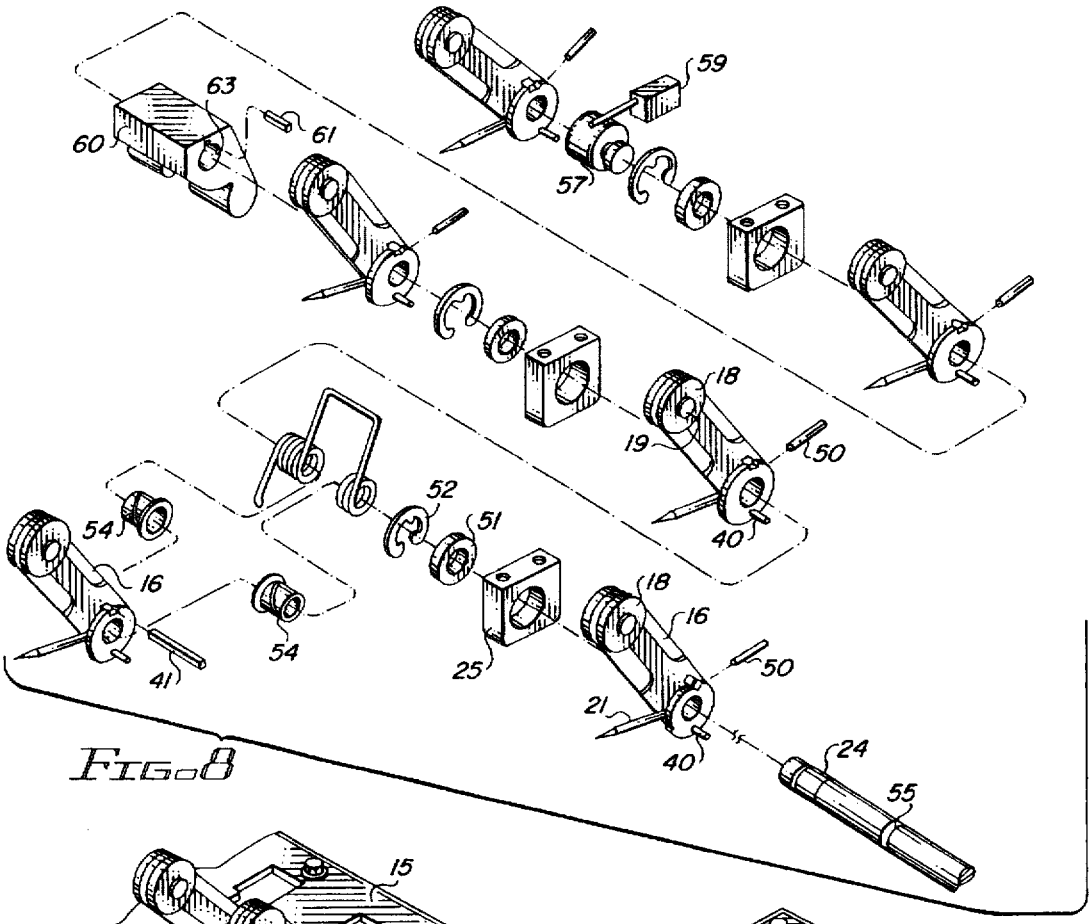
FIG. 8 is an exploded view showing the assembly of the lever arms on shaft.

The placement of the various components on a portion of the shaft 24 is shown in the exploded view of FIG. 8 wherein the sequence of assembly of parts positioned on shaft 24 is shown by the dash line extending through the various parts. As shown in FIG. 8, shaft 24 is provided with locating grooves 55 spaced along its axis. Each lever arm 16 is provided with a shaft pin 50 such that placement of the lever arm on the shaft and moving it therealong to a position at a locating groove enables the shaft pin 50 to be fully inserted and thereby establish spacing on the shaft. At the time of placement, the lever 16 is provided with the rotating discs 18, spike 21 and spring pin 41 as shown. After positioning of the lever arm, the next part in the sequence is bearing block 25 which receives a bearing insert 51 therein. An E-clip 52 is then placed on the shaft followed by a lever arm associated with a spring. One portion of the spring is placed on the shaft followed by a spring sleeve 54. Next, the lever arm with spring pin 41 inserted therein is placed on shaft 24 followed by a second spring sleeve and the remaining coil of the spring. As shown, the sequence of assembly continues until shaft guide block 60 is utilized. It is to be noted that the shaft guide block 60 is provided with a keyway 63 which aligns with a like keyway in the shaft to receive key 61. In the operation of the system, the shaft guide is driven as it will later be explained by a hydraulic ram to impart rotation to the shaft 24. In the foregoing discussion, the retraction of the lever arms to the position shown in FIG. 7 is caused by the operator at the toll gate actuating the hydraulic system to permit authorized vehicles to pass without encountering extended lever arms.

Figure 12A:
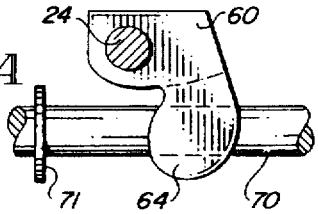
FIG. 12A and 12B are side views of the follower of FIG. 11 taken as indicated by line 12A—12A.
Figure 12B:
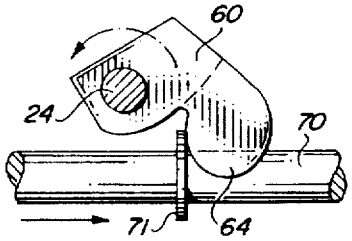
Figure 11:
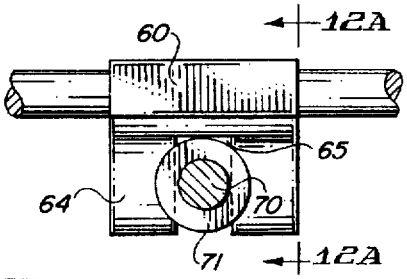
FIG. 11 is a front view of the hydraulic ram follower mounted on the shaft.

The shaft guide block 60 is shown in further detail in FIGS. 11, 12A and 12B. In FIG. 11, the guide block is shown in a front view secured to the shaft 24 with spaced depending lobes 64 defining a passage 65 therebetween. The hydraulic ram 70 extends through the central passage as shown more clearly in FIGS. 12A and 12B. A contact collar 71 is secured to the hydraulic ram 70 and is positioned to contact the adjacent cam surfaces of lobes 64 when the ram is extended.

The system rest position is shown in FIG. 12A wherein the hydraulic ram is positioned so that the contact collar is spaced from the cam surfaces of guide 60. This position corresponds to the position of the lever arm shown in FIG. 5 wherein the spring urges the levers to an upwardly extending position. The contact collar 71 is located on the shaft so that it permits independent rotation of shaft 24 in the clockwise direction when the ram is retracted. This rotational movement corresponds to the contacting of an extended lever arm by a tire of an unauthorized vehicle trying to pass the toll booth. When a vehicle is authorized to pass and the hydraulic system is actuated by the operator, the hydraulic ram 70 is driven in the direction of the arrow in FIG. 12B so that the contact collar provides a caming action to the guide 60. The caming surfaces of the lobes 64 are curved to facilitate movement of the collar therealong as the ram 70 extends in the direction of the arrow.

Figure 9:
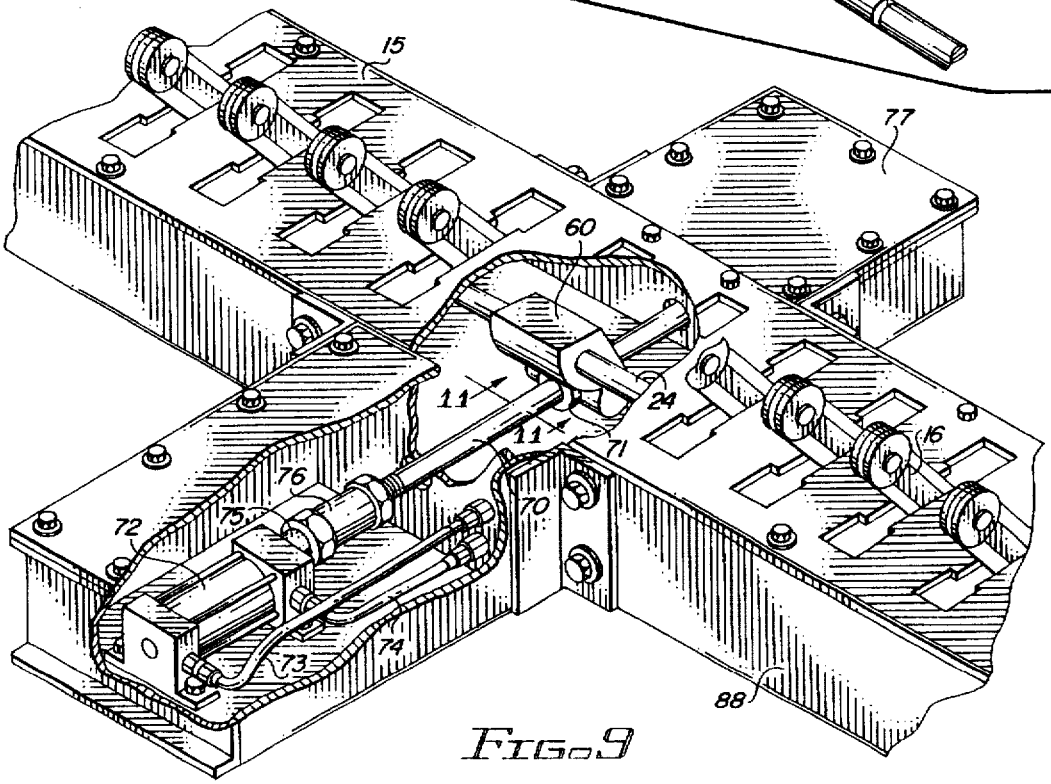
FIG. 9 is a perspective view in partial section showing the hydraulic assembly of the present invention.

The hydraulic system is shown in the partial cutaway view of the system housing shown in FIG. 9. Hydraulic lines 73 and 74 are connected to an external pump (not shown) and to the hydraulic cylinder 72. When the system is actuated, the hydraulic cylinder extends the primary ram 75 outwardly from its housing. The primary ram 75 has, at its free end a coupler 76, connected to the hydraulic ram 70. As mentioned previously, ram 70 contains a contact collar fixedly located thereon which engages the lobes 64 of guide 60. In FIG. 9, the linkage is shown beginning the initial contact with the lobes of the guide to urge the upwardly extending lever arms 16 downwardly to the retracted position which permits vehicles to pass thereover. The embodiment shown in FIG. 9 is intended to be located below the surface of the roadway with plate 15 in general surface alignment. The housing 88 is preferably fabricated from steel plates to ensure that the assembly can support the weight of vehicles moving thereacross. The top plate 77 for the hydraulic assembly is also made to be at the level of the road surface to facilitate adjustment and repair of the hydraulic assembly.

Figure 13:
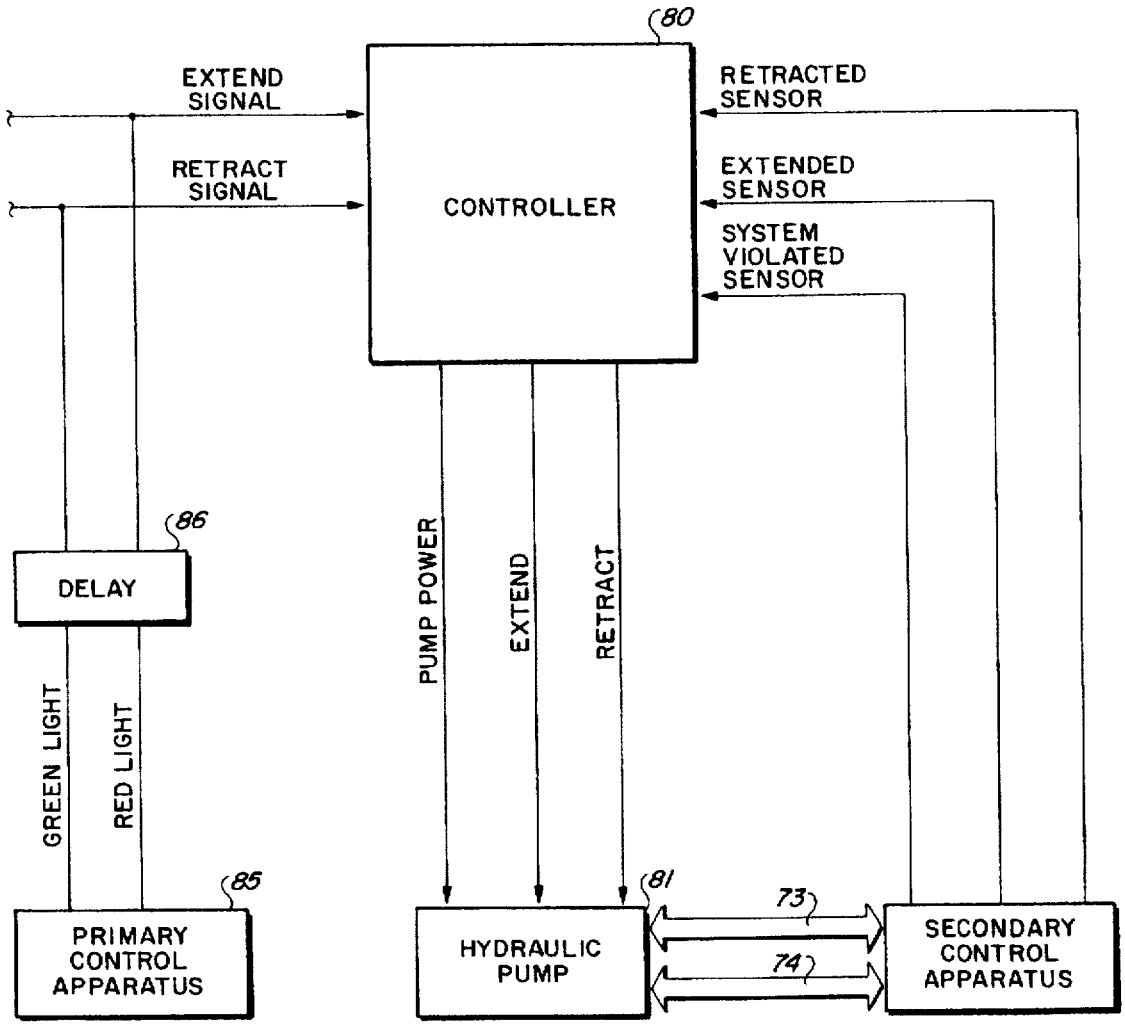
FIG. 13 is a block schematic diagram showing the control system for one embodiment of the invention.

The system block diagram is shown in FIG. 13 wherein a programmable logic controller 80 is responsive to signals from the operator to either extend the lever arms or retract them. In the embodiment shown the electronic logic controller 80 is an integrated circuit model 620MDR114 manufactured by General Electric. The controller 80 starts the hydraulic pump and begins to cause the ram of the hydraulic cylinder to extend thereby urging the lever arms to a position below the plate. As shown, the lever arm extend signal is also directed to the primary directional control apparatus, shown as a red-green traffic light in FIG. 1, so that an oncoming motorist will see a red light and know that the vehicle is to stop. The red light indicates that the lever arms are either extended or in the process of being extended. The controller is connected to the hydraulics pump 81 and provides three signals. The first signal is to activate the pump, the second signal is to extend the lever arms and the third is to retract same. The hydraulic pump (not shown) is coupled by hydraulic lines 73, 74 to hydraulic cylinder 72 as seen in FIG. 9.

In operation, the extension of the primary ram 75 causes shaft 24 to rotate and the lever arms are retracted to a position beneath plate 15. The retraction of the primary ram 75 permits the spring-loaded lever arms to return to the upwardly extended position as shown in FIG. 9. As mentioned in connection with FIG. 8, shaft 24 contains a switch trip cylinder 57 which is operatively connected to a microswitch 59 to indicate whether the lever arms are forced to rotate by the application of an external force. The present system is shown in FIG. 13 as the secondary directional control apparatus and the status information is furnished to the controller 80. The primary directional control apparatus 85 contains the red and green lights prominently displayed to the vehicle operator. When the controller is instructed to extend the lever arms, the extend signal is supplied to control apparatus 85 to cause the red light to immediately be lighted. However, the retract signal is supplied to control apparatus 85 through a delay line 86 which allows the retraction of the lever arms to be completed before the green light is turned on.

The controller 80 receives the retracted and extended sensor signals from the hydraulic cylinder 72 which contains proximity switches therein. The proximity switches are responsive to the position of the piston in the hydraulic cylinder. At the end of the stroke extending or retracting primary ram 75, a signal indicating the position of the lever arms is provided to the controller 80. In addition to the signals from the proximity switches, a system violated signal is also provided to the controller. The sensor to show that the system has been violated by the unauthorized passage of a vehicle utilizes a microswitch mounted on the frame or sidewalls of the housing beneath plate 15 and having a switch arm which rests on the switch trip cylinder 57 shown in FIG. 8. This cylinder contains an eccentric portion so that when rotated in the direction to cause the tire disabling spikes to extend upwardly beyond plate 15, the microswitch is opened and a signal is sent to the controller 80. As a result of the system being violated and the microswitch being opened, an alarm is sounded. The lever arms return to the position shown in FIG. 9 as a result of the biasing force of the springs on the shaft. It is to be noted that the switch trip cylinder not only indicates the system has been violated by a vehicle, but also provides an indication if an attempt is made to defeat the system by the placement of a board or object on the lever arms forcing them down beneath the surface of plate 15. The switch trip cylinder rotates in the opposing direction in this situation and the eccentric portion thereof actuates the microswitch.

Figure 14:
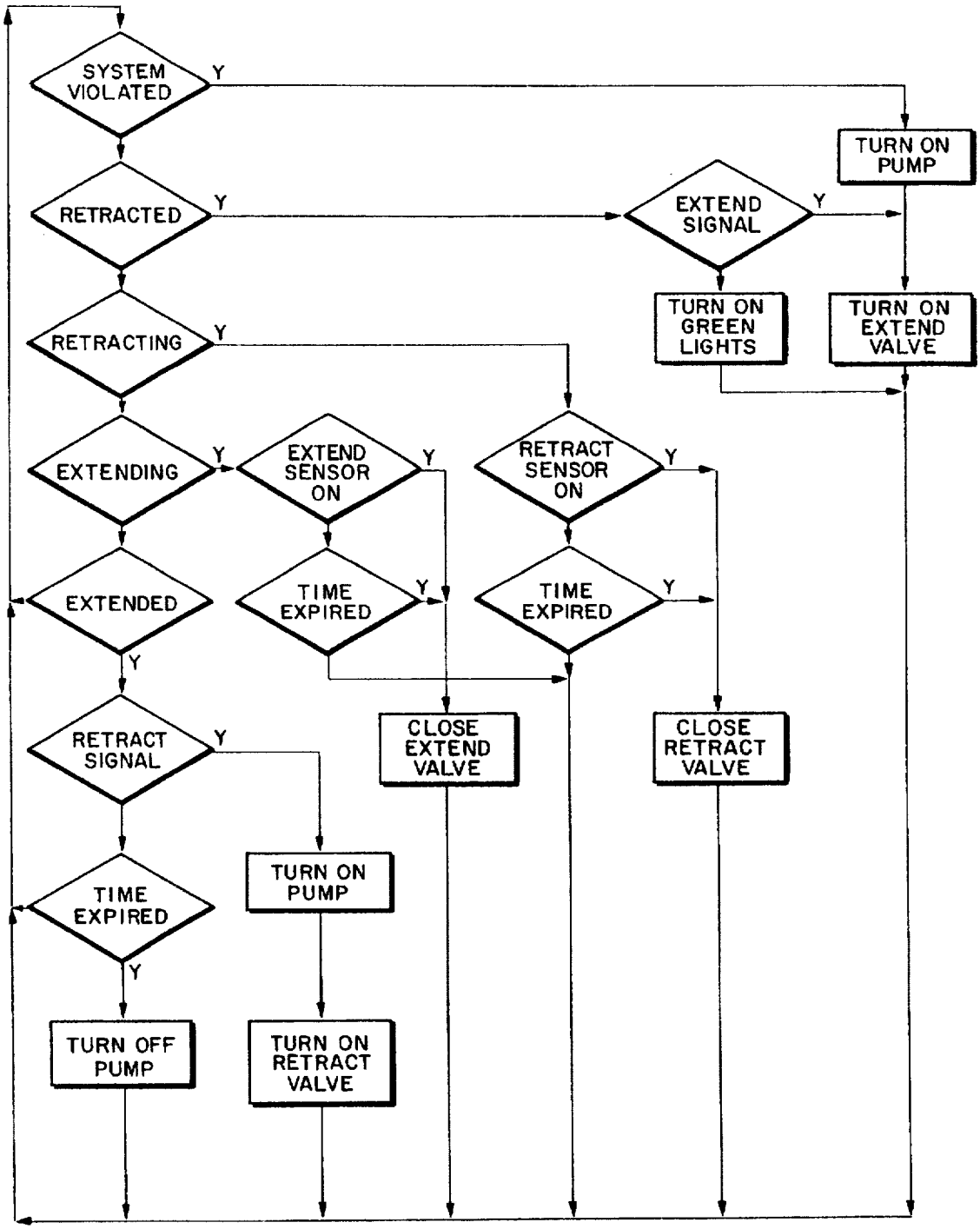
FIG. 14 is an operational flowchart for the preferred embodiment.

The system operation can be readily understood from the operational flow chart shown in FIG. 14. The flow chart illustrates the sequence of events taking place for the different conditions under which the present invention is intended to operate. The first condition calls for inquiry as to whether the system has been violated either by an unauthorized vehicle or by an attempt to defeat the system. This condition is sensed by the microswitch responsive to the switch trip cylinder located on the lever arm shaft. If this condition exists, the controller is instructed to turn on the pump and to provide that the ram in the hydraulic system is completely retracted. This enables the lever arms to return to the extended position above the plate. If the inquiry shows the system not to have been violated, the state of the proximity switch in the hydraulic cylinder corresponding to the fully extended position of the ram showing the lever arms to have been retracted is monitored. The controller then determines if the operator has entered a lever extend signal and, if that is correct, the appropriate valve in the hydraulic system is open. If no extend signal has been entered, the green light is lighted and a vehicle may proceed. When the apparatus is engaged in retracting lever arms or extending the lever arms, the movement of the primary ram 75 from the hydraulic cylinder continues until an internal proximity switch is actuated. If no signal occurs from the switch indicating a completion of this step of the operation, the appropriate extend or retract valve is closed after the preset interval. When the controller receives a signal that the ram is fully extended indicating that the lever arms are positioned beneath the top plate, the controller looks to see if a signal calling for retraction of the ram and a return of the lever arms to the normal operating position has been sent by the operator. If the lever retract signal has been sent, the pump is turned on and the retract valve in the hydraulic system is opened. In the event that no retract signal is received and the lever arms are beneath the plate, the controller waits for a predetermined interval and the pump is turned off. In practice, the preset time value for turning the pump off when the lever arms are in the normal operating position is two minutes. The same time interval is used to close the retract valve to maintain the lever arms in a position beneath the plate until a signal calling for the change of position is received by the controller.

The foregoing description of a preferred embodiment of the invention concerns the use of the apparatus as a secondary traffic control device limiting traffic past a control point to authorized vehicles. The primary control device is a visual display, typically a red-green traffic light. However, other combinations of traffic control devices such as barrier arms and gates may be employed with the present invention. It is the secondary system that provides the means to disable the vehicle that violates the control point. As described, the system has been tested and found to work quite well for a one-way traffic control point. It is to be noted that vehicles are not prevented from violating the system from the wrong direction except by the primary control device. In applications where it is necessary to prevent such occurrences, a tertiary control device is needed. This can be accomplished by the use of a duplicate of the described embodiment rotated 180° and adjacently placed in the road bed. Both sets of lever arms are then simultaneously retracted to allow vehicles to pass through the control point. When the lever arms are extended, a vehicle attempting to violate the system from either direction would be disabled.

While the above description has referred to a specific embodiment of the invention, it is recognized that variations and modifications may be made therein without departing from the scope of the invention as claimed.

We claim:

1. Apparatus for controlling the passage of vehicles past a control point which comprises:

a) a planar member for supporting motor vehicles traveling thereacross, said member having a plurality of openings thereacross;

b) a shaft journaled for rotation and located beneath said planar member;

c) a plurality of lever arms affixed to said shaft and aligned with said plurality of openings, each lever arm having a first end extending upwardly through one of said openings to a first position for contacting a vehicle tire passing across the planar member;

d) drive means for imparting rotation to the shaft and retracting the lever arms to a second position beneath said planar member;

e) means for actuating said drive means to impart rotation to said shaft;

f) biasing means for urging the lever arms to the first position; and g) a plurality of tire disabling members operatively connected to said lever arms beneath the planar member, said disabling members rotating with the lever arms to engage a tire when a vehicle is moving across the planar member and contacts said lever arms.

2. The invention in accordance with claim 1 wherein said plurality of lever arms are affixed to the shaft to form an acute angle with the planar member oriented toward an oncoming vehicle in the first position.

3. The invention in accordance with claim 2 wherein said drive means comprises a hydraulic cylinder having an extendible ram, said ram moving between extended retracted positions, and said apparatus further comprising a shaft guide block affixed to said shaft and positioned for contact by the extendible ram to impart rotation thereto.

4. The invention in accordance with claim 3 wherein said extendible ram includes a collar affixed thereto for contacting the shaft guide block when the ram is extended.

5. The invention in accordance with claim 4 wherein said shaft guide block is provided with curved bearing surfaces for engagement with said collar.

6. The invention in accordance with claim 5 wherein said collar is affixed to the ram at a location spaced from said shaft guide block when the ram is in the retracted position.

7. The invention in accordance with claim 6 wherein said biasing means comprises a plurality of springs spaced along the shaft, each spring engaging an adjacent lever arm and urging said lever arm to the first position.

8. The invention in accordance with claim 1 further comprising a primary control device coupled to said drive means for visually displaying the position of the lever arms.

9. The invention in accordance with claim 8 wherein said drive means comprises a hydraulic cylinder having an extendible ram, said ram moving between extended and retracted positions, and said primary control device being coupled to said hydraulic cylinder to determine the position of the lever arms.

10. The invention in accordance with claim 9 further comprising a delay circuit coupled to the primary control device for imparting a delay to the display indicating the lever arms are in the second position.

11. The invention in accordance with claim 10 further comprising a shaft guide affixed to said shaft and positioned for contact by the extendible ram to impart rotation thereto.

12. The invention in accordance with claim 11 wherein said extendible ram includes a collar for contacting the shaft guide block when extended, said collar affixed thereto at a location spaced from the shaft guide when the ram is retracted to permit rotation of the shaft guide.

13. The invention in accordance with claim 12 wherein said biasing means comprises a plurality of springs spaced along the shaft, each spring engaging an adjacent lever arm and urging said lever arm to the first position.

14. The invention in accordance with claim 13 wherein the means for actuating said drive means includes an electronic controller coupled to the hydraulic cylinder for controlling the operation thereof.

15. The invention in accordance with claim 14 further comprising means affixed to said shaft for indicating rotation of the shaft by the application of an external force and providing a signal to the controller.

* * * * *